United States Patent [19]

Despot

[11] 4,395,947

[45] Aug. 2, 1983

[54] ADJUSTING DEVICE FOR INKING AND DAMPING ROLLERS ON PRINTING PRESSES

[75] Inventor: Janko Despot, Offenbach am Main, Fed. Rep. of Germany

[73] Assignee: M.A.N.- ROLAND Druckmaschinen Aktiengesellschaft, Offenbach am Main, Fed. Rep. of Germany

[21] Appl. No.: 383,753

[22] Filed: Jun. 1, 1982

[30] Foreign Application Priority Data

Jun. 19, 1981 [DE] Fed. Rep. of Germany ..... 3123990

[51] Int. Cl.[3] ..... B41F 31/34

[52] U.S. Cl. ..... 101/352; 101/148; 101/247

[58] Field of Search ..... 101/351, 352, 247, 147, 101/148, 209; 74/22 R

[56] References Cited

U.S. PATENT DOCUMENTS 3,603,254 9/1971 Siebke ..... 101/351 X 3,691,956 9/1972 James et al. ..... 101/352 X

*Primary Examiner*—Clifford D. Crowder

*Attorney, Agent, or Firm*—Leydig, Voit, Osann, Mayer & Holt, Ltd.

[57] ABSTRACT

An adjusting and throw-off mechanism for use with an applicator roller and a distributor roller in a printing press. An eccentric sleeve bearing surrounds the shaft of the applicator roller. A plunger having a rack and pinion connection with the sleeve bearing is threaded at its end and engaged by a cylindrical nut. A nut carrier is provided in the form of a cylinder telescoped over the nut, the nut being rotatable with respect to the carrier but axially captive therein. The nut carrier is telescopingly received in a bracket secured to the press frame. A positioning device in the form of a crank is interposed between the carrier and the bracket for moving the carrier and nut into a reference position so that upon turning the nut the plunger is axially moved to adjust the eccentric sleeve bearing thereby to adjust the pressure between the rollers. The crank is movable to a throw-off position accompanied by gross rocking movement of the sleeve bearing thereby to disengage the applicator roller from the distributor roller. A stop in the path of movement of the crank accurately defines the reference position so that, when the crank is restored to reference position following throw-off, the adjusted pressure between the rollers is accurately reestablished.

4 Claims, 6 Drawing Figures

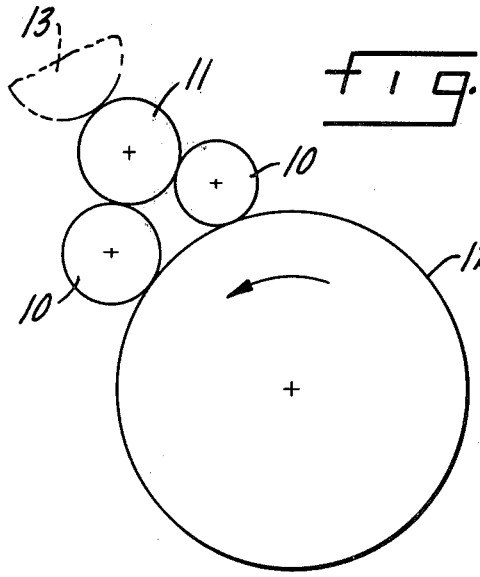
Fig. 1.
Fig. 4.
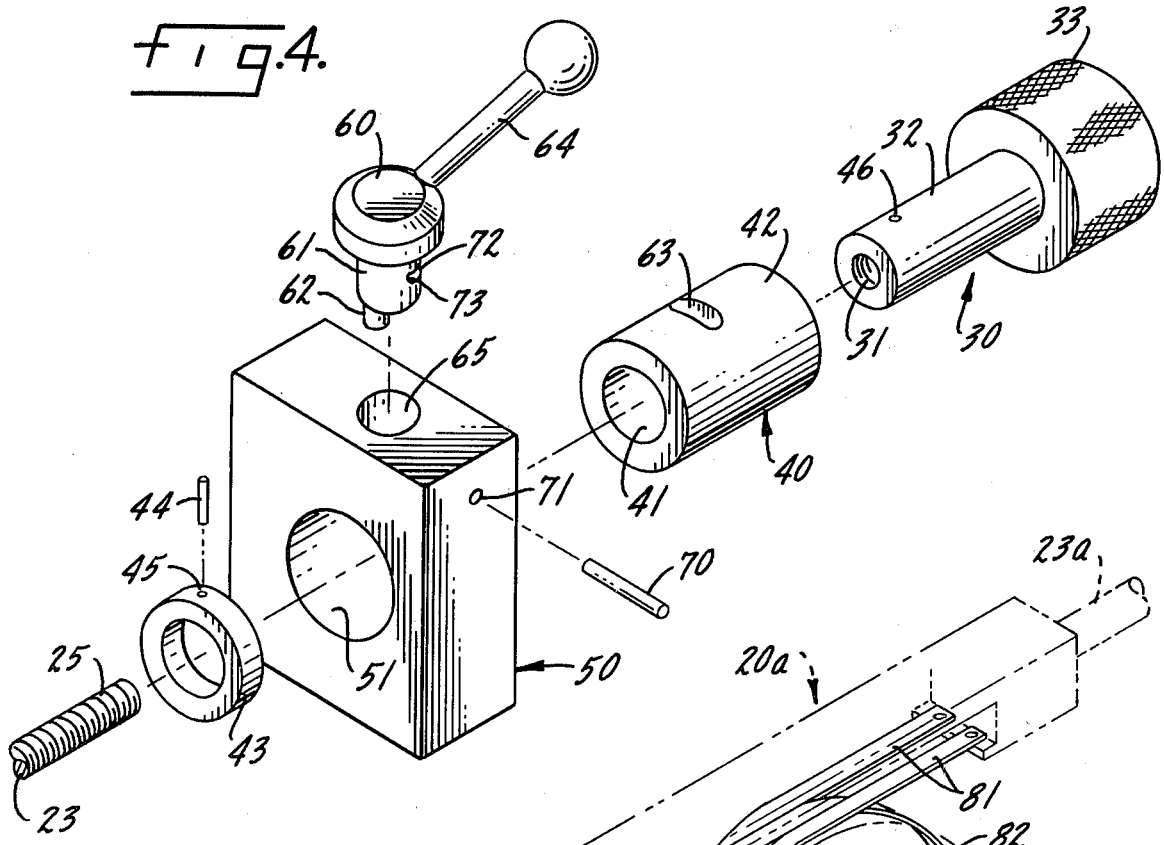
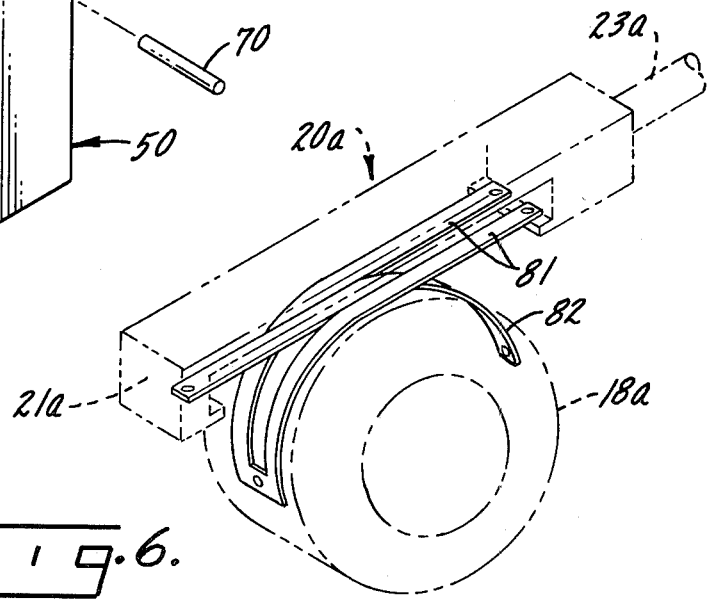
Fig. 6.

10
11
12
15
17
18
20
21
22
23
24
25
30
31
32
33
40
41
42
43
44
45
46
50
51
60
61
62
63
64
70
72
73

ADJUSTING DEVICE FOR INKING AND DAMPING ROLLERS ON PRINTING PRESSES

In an inking or dampening system of a lithographic press fluid is transferred to the plate on the plate cylinder by means of "form", or applicator, rollers which receive the fluid from a hard surfaced distributor roller with which the applicator rollers are in indented pressure engagement. It is known to provide means for adjustment and throw-off of the applicator rollers with respect to the plate cylinder as shown, for example, in German Registered Design No. 1,929,534. In such construction the inking or dampening rollers are mounted on arms which are swingable, by a pressure actuator, about the axis of the distributor roller. Adjusting nuts, which limit the stroke of the actuator, determine the running pressure of the applicator rollers with respect to the printing plate.

However such an arrangement does not provide for the throw-off of the resilient applicator rollers with respect to the hard distributor roller so that when the press has been out of use for a period of time the applicator rollers tend to develop a "flat" requiring early replacement.

It is, accordingly, an object of the present invention to provide, in a printing press, a combined adjusting and throw-off mechanism for an applicator roller with respect to a distributor roller. It is another object to provide a combined adjusting and throw-off mechanism which permits a fine adjustment of the pressure between the applicator roller and the distributor roller under normal running conditions, which has provision for throw-off to prevent development of a flat on the applicator roller, but in which the adjusted pressure, following throw-off, is automatically reestablished. It is a more specific object to provide a combined adjusting and throw-off mechanism having a thread for adjustment purposes but in which a positioning device is provided for the threaded member movable between a reference position, in which the adjustment is made, and a throw-off position, the positioning device having a stop in its path of movement for accurately defining the reference position so that when the positioning device is restored to reference position following throw-off the adjusted pressure between the rollers is accurately reestablished.

It is a general object of the present invention to provide a combined adjusting and throw-off mechanism for an applicator roller within a printing press which greatly extends the life of the applicator roller, which enables economies of operation since it does not require time-consuming readjustment of operating pressure following throw-off, and which is simple and economical to make and install, providing reliable operation over long periods of time without care or maintenance.

Other objects and advantages of the invention will become apparent upon reading the attached detailed description and upon reference to the drawings in which:

FIG. 1 is a diagram showing the position of the form, or applicator, rollers with respect to the distributor roller and plate cylinder in a printing press.

FIG. 4 is an exploded perspective.

FIG. 6 shows a form of rack and pinion connection which may be employed in practicing the present invention.

While the invention has been described in connection with a preferred embodiment, it will be understood that I do not intend to be limited to the particular form of the invention which has been shown but intend, on the contrary, to cover the various alternative and equivalent constructions included within the spirit and scope of the appended claims.

Figures 2, 5:
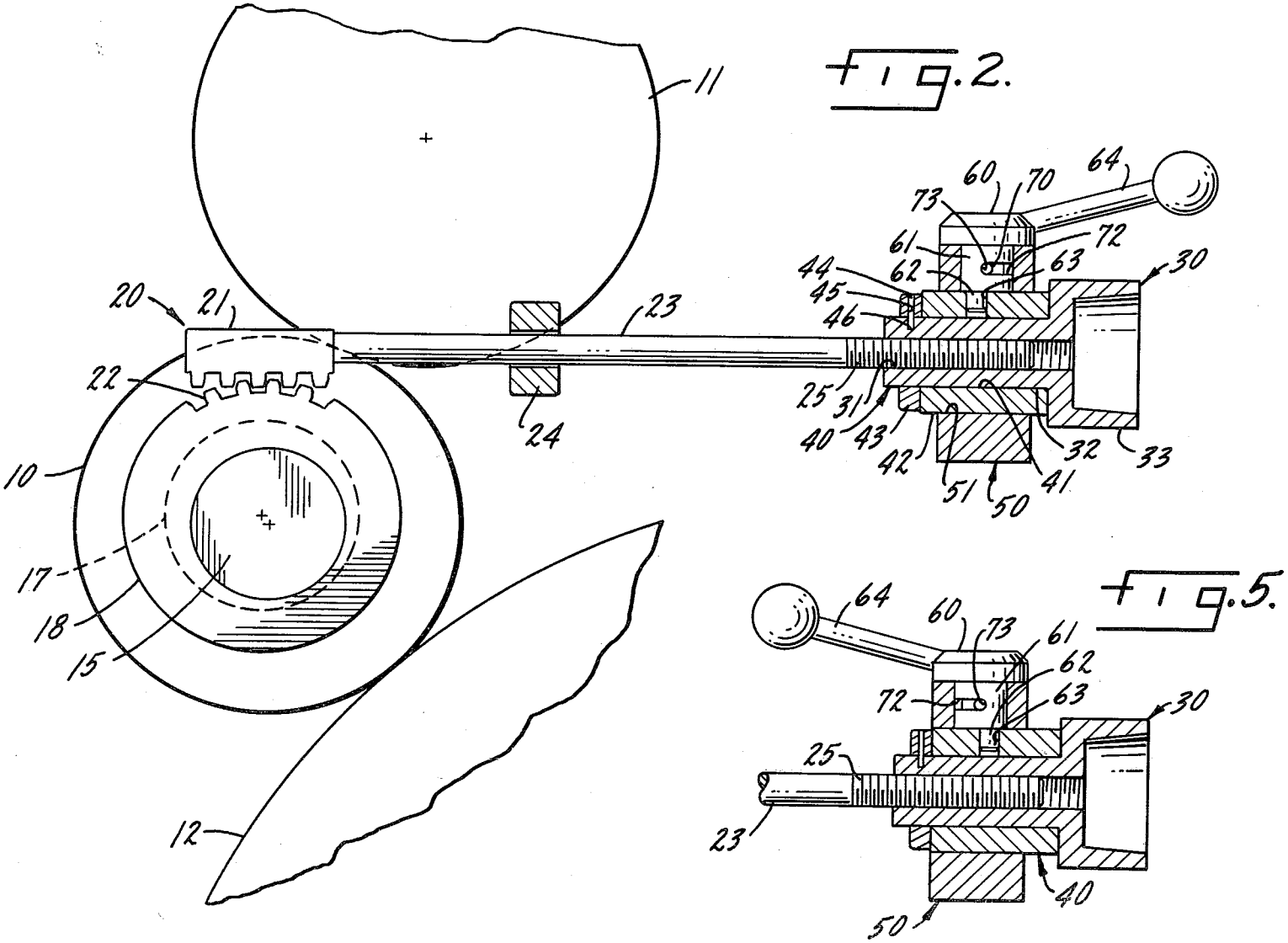
FIG. 2 is a side elevation, in partial section, showing the combined adjusting and throw-off mechanism constructed in accordance with the invention.
FIG. 5 shows the device of FIG. 2 in the thrown-off condition.
Figure 3:
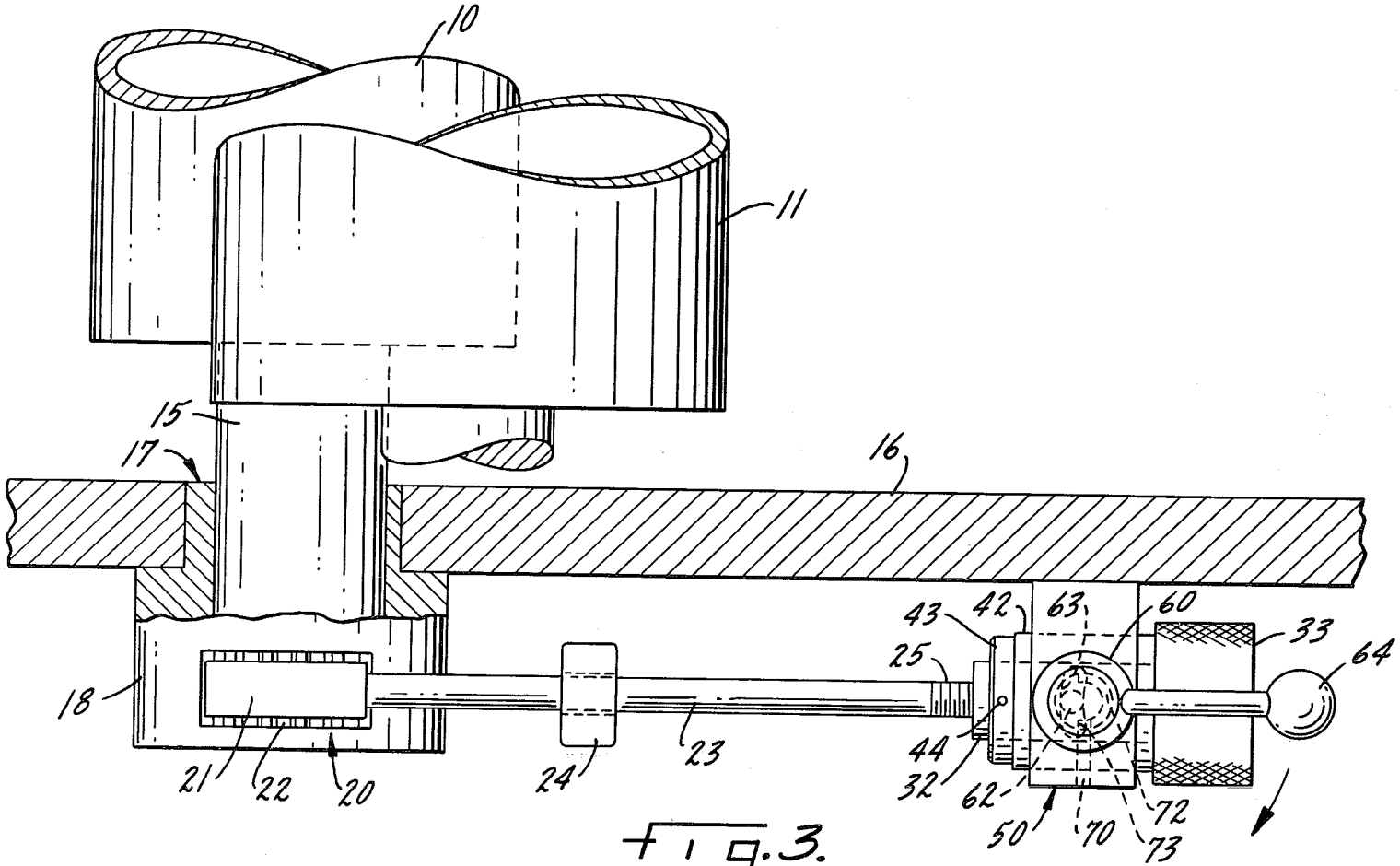
FIG. 3 is a top view of the mechanism shown in FIG. 2.

Turning now to the drawings, there is shown, in FIG. 1, a pair of resilient applicator, or "form", rollers 10 receiving fluid from a hard surfaced distributor roller 11 and in rolling engagement with a plate (not shown) on a plate cylinder 12. The distributor roller 11 is furnished with fluid from any desired source indicated diagramatically at 13. As shown in FIGS. 2 and 3, a typical one of the applicator rollers 10 has a shaft 15 journalled in a frame plate 16. Interposed between the shaft and frame plate is an eccentric bearing sleeve 17 having a hub 18. The hub provides a rack and pinion connection 20 consisting of a rack 21 and a pinion in the form of a gear segment 22 integrally formed on the hub. The rack is connected to a plunger 23 having a guide 24.

In accordance with the present invention the plunger is threaded at its end and is engaged with a cylindrical threaded member, here serving as a nut, the cylindrical threaded member being mounted in a carrier in which it is axially captive, the carrier being telescopingly received in a bracket secured to the press frame. A positioning device in the form of a crank interposed between the carrier and the bracket moves the threaded member into a reference position so that upon turning the threaded member the plunger in axially moved to adjust the eccentric sleeve bearing thereby to adjust the pressure between the rollers. The positioning device is movable to a throw-off position accompanied by gross movement of the plunger and gross rocking movement of the sleeve bearing thereby to disengage the applicator roller from the distributor roller. The positioning device has a stop in its path of movement for accurately defining the reference position, so that when the positioning device is restored to reference position, following throw-off, the adjusted pressure between the rollers is accurately reestablished.

Thus as shown in the drawings, the end of the plunger is threaded as at 25. The thread is engaged by a cylindrical threaded member shown here as a nut 30 having an internal thread 31, a cylindrical outer surface 32 and a knob 33. As will be seen, rotating the knob backwardly or forwardly moves the plunger in one direction or the other to rock the bearing sleeve to vary the pressure between the rollers 10 and 11.

For mounting the nut 30 a nut carrier, or slideable block, 40 is provided having a smooth cylindrical inner surface 41 and an outer surface 42 which, in the present instance, is also cylindrical. For holding the nut axially captive within the carrier while permitting free rotation of the nut, a retaining ring 43 is provided which is secured by suitable means to the presented end of the nut. In the present instance this is accomplished by a pin 44 which engages registering openings 45, 46.

For the purpose of receiving the carrier, a bracket 50 is provided, anchored by suitable means to the press frame, and which is of hollow construction having a central opening 51 which is dimensioned to telescopingly receive the carrier 40.

In carrying out the invention, a positioning device is interposed between the carrier and the bracket for moving the carrier and threaded member to a reference position, in which the roller to roller pressure is adjusted, and a throw-off position in which the applicator roller is disengaged from the distributor roller. In the present instance such positioning device is in the form of a crank 60 having a crank shaft 61 and an eccentric crank projection 62, the carrier 40 being provided with a transversely arranged slot 63 which snugly engages the crank projection. A cylindrical opening 65 is provided in the bracket at right angles to the central opening 51 for the purpose of journalling the crank shaft 61 so that, when the handle is swung from one side to the other, the carrier 40 and the nut 30 which it contains is shifted between a reference position and a throw-off position.

For the purpose of accurately determining the reference position of the carrier 40 and nut 30 with respect to the press frame, a stop is provided in the path of movement of the crank. Such stop is here in a form of a pin 70 which is fitted into an opening 71 formed in the bracket. The end of the pin registers with an annular groove 72 formed in the crank shaft, the groove having an end or stop surface 73. In FIG. 2 the pin 70 is shown engaging the stop 73 so that the device is in its reference condition. The pin 70 not only serves as a stop for reference purposes but as a retainer preventing endwise dislodgement of the crank 60.

Upon throwing the handle 64 to the opposite, or throw-off, position, illustrated in FIG. 5, the crank 60 is rotated 180°, i.e., until the stop pin 70 is engaged by the opposite end of the annular groove 72. This causes the crank projection 62 to undergo a semicircle of movement causing the carrier 40 and nut 30 to shift to the right thereby imparting a gross shifting movement to the plunger and bearing sleeve to rotate the latter into a position in which the applicator roller 10 is disengaged from the distributor roller 11. When it is stated that the applicator roller is "disengaged" from the distributor roller it is not necessarily meant that the two rollers are moved out of contact but rather that the pressure between them is released so that there is no longer any tendency for the applicator roller to take on a set, or develop a "flat" by reason of continued stress while the press is not being used.

It is one of the detailed features of the present invention that the crank projection 62 is so phased with respect to the stop surface 73 that the crank is substantially on dead center when in reference position. In other words, when the device is in reference position, as it will be during adjustment or normal running of the press, no amount of force applied to the plunger 23 will be effective to cause dislodgement.

In a typical operating sequence the handle 64 is swung to reference position (FIGS. 2 and 3) and the adjusting knob 33 is rotated by the fingertips to produce an adjusted level of force between the two rollers, slightly indenting the applicator roller. When the press is shut down the handle is swung 180° to its position of throw-off (FIG. 5) causing gross rocking movement of the eccentric sleeve bearing in a direction to relieve the pressure, thereby avoiding the creation of a "flat". When it is desired to resume operation, the handle is again swung to the reference position in which the endwise position of the nut is automatically restored thereby accurately reestablishing the adjusted pressure between the rollers without necessity for readjustment or even touch-up.

For the sake of symmetry, the same adjusting and throw-off means, in mirror image, is preferably provided at each of the applicator roller.

It will be apparent to one skilled in the art that minor changes may be made in the construction without departing from the invention. Thus, while in the preferred construction the plunger carrier has a male thread 25 and the element 30 carries the internal thread 31, it will be apparent to one skilled in the art that the positioning of the male and female threads may, if desired, be interchanged. Moreover, while I prefer to use a conventional rack-and-pinion connection 20, an equivalent connection may be substituted as indicated at **20*a* in FIG. 6, where corresponding reference numerals are employed with addition of subscript a. Here the "rack" 21*a* at the end of the plunger 23*a* is connected by metallic ribbons 81, 82 to the hub 18*a*** of the bearing sleeve. With this construction in mind it will be understood that the term "rack and pinion connection" will be understood to mean any means for converting the reciprocating movement of the plunger to rocking movement of the bearing sleeve.

And while it is preferred that the outer surface of the carrier 40 shall be of circular profile for telescoping within the circular central opening 51 of the bracket 50, this is not necessary to practice the invention, and the cross sections may be of any matching profile without departing from the invention. Also while the device as presently shown utilizes a relatively limited gross movement of a plunger and bearing sleeve to achieve shut-off, the diameter of the crank shaft, and hence the throw of the crank projection 62, may be made as large as desired to ensure that the rocking movement of the bearing sleeve is, indeed, adequate to achieve the desired degree of throw-off.

I claim as my invention:

1. A combined adjusting and throw-off mechanism for a printing press comprising, in combination, a frame including side plates, an applicator roller having a stub shaft journalled in a side plate, means including a distributor roller journalled in the side plate adjacent the applicator roller, means for feeding fluid to said applicator roller, an eccentric sleeve bearing interposed between the stub shaft of the applicator roller and the side plate for adjusting the pressure between the rollers, a rack and pinion connection including a rack and a pinion on the sleeve bearing, a plunger connected to the rack, the plunger being threaded at its end, a cylindrical nut internally threaded to mate with the plunger, a nut carrier in the form of a cylinder telescoped over the nut, the nut being rotatable with respect to the carrier but axially captive therein, a hollow bracket fixed to the side plate, the nut carrier being telescopingly received in the bracket, a positioning device interposed between the carrier and the bracket for moving the carrier and nut into a reference position with respect to the bracket so that upon turning the nut the plunger is axially moved to rock the eccentric sleeve bearing thereby to adjust the pressure between the rollers, the positioning device being movable to a throw-off position accompanied by gross movement of the plunger and gross rocking movement of the sleeve bearing thereby to disengage the applicator roller from the distributor roller, and means including a stop on the bracket in the path of movement of the positioning device for accurately defining the reference position so that, when the positioning device is restored to reference position following throw-off, the adjusted pressure between the rollers is accurately re-established.

2. A combined adjusting and throw-off mechanism for a printing press comprising, in combination, a frame including side plates, an applicator roller having a stub shaft journalled in a side plate, means including a distributor roller journalled in the side plate adjacent the applicator roller for feeding fluid to said applicator roller, an eccentric sleeve bearing interposed between the stub shaft of the applicator roller and the side plate for adjusting the pressure between the rollers, a rack and pinion connection including a rack and a pinion on the sleeve bearing, a plunger connected to the rack, the plunger being threaded at its end, a cylindrical threaded member mating with the thread on the plunger, a carrier for mounting the cylindrical member, the cylindrical member being rotatable with respect to the carrier but axially captive therein, a hollow bracket fixed to the side plate, the carrier being telescopingly received in the bracket, a positioning device interposed between the carrier and the bracket for moving the carrier and threaded member into a reference position with respect to the bracket so that upon turning the threaded member the plunger is axially moved to rock the eccentric sleeve bearing thereby to adjust the pressure between the rollers, the positioning device being movable to a throw-off position accompanied by gross movement of the plunger and gross rocking movement of the sleeve bearing thereby to disengage the applicator roller from the distributor roller, the positioning device having a stop in its path of movement for accurately defining the reference position so that, when the positioning device is restored to reference position following throw-off, the adjusted pressure between the rollers is accurately re-established.

3. The combination as claimed in claim 1 or in claim 2 in which the positioning device for the carrier is in the form of a crank journalled in the bracket and rockable between reference and throw-off positions, the stop being placed to define the limit of rocking movement of the crank so that the crank is substantially on dead center when in reference position.

4. The combination as claimed in claim 1 or in claim 2 in which the bracket contains a central opening for snug telescoped reception of the nut carrier and a cylindrical opening at right angles thereto, the positioning device being in the form of a crank having a shaft fitted for rocking movement in the cylindrical opening and having a handle, the crank having an eccentrically located projection at its inner end, the carrier having a transversely arranged slot for snugly receiving the projection, the stop being positioned to limit movement of the crank between accurately determined limit positions.

* * * * *